US007302073B2

(12) United States Patent
Smith et al.

(10) Patent No.: US 7,302,073 B2
(45) Date of Patent: Nov. 27, 2007

(54) METHOD OF DETECTING AND DETERRING MICROPHONE SABOTAGE

(75) Inventors: Richard A. Smith, El Dorado Hills, CA (US); Reginald C. Kouwenberg, Eindhoven (NL)

(73) Assignee: Honeywell International, Inc., Morristown, NJ (US)

( * ) Notice: Subject to any disclaimer, the term of this patent is extended or adjusted under 35 U.S.C. 154(b) by 315 days.

(21) Appl. No.: 10/856,019

(22) Filed: May 28, 2004

(65) Prior Publication Data

US 2005/0265571 A1 Dec. 1, 2005

(51) Int. Cl.

| | |
|---|---|
| ***H04R 19/04*** | (2006.01) |
| ***H04R 17/02*** | (2006.01) |
| ***H04R 9/08*** | (2006.01) |
| ***H04R 21/02*** | (2006.01) |

(52) U.S. Cl. ..... 381/369; 381/355; 381/360; 381/361

(58) Field of Classification Search ..... 381/191, 381/355, 359, 360, 361, 365
See application file for complete search history.

(56) References Cited

U.S. PATENT DOCUMENTS

| | | | | |
|---|---|---|---|---|
| 5,329,593 | A * | 7/1994 | Lazzeroni et al. | 381/357 |
| 6,201,876 | B1 | 3/2001 | Niemi et al. | |
| 6,744,900 | B1 * | 6/2004 | Turner et al. | 381/355 |

* cited by examiner

*Primary Examiner*—Curtis Kuntz
*Assistant Examiner*—Tuan Duc Nguyen
(74) *Attorney, Agent, or Firm*—Scully, Scott, Murphy & Presser, P.C.

(57) ABSTRACT

A protective grommet for a microphone has an enclosure with an internal cavity. The internal cavity is dimensioned to receive an input end of the microphone therein. A membrane, particularly a mesh, and more particularly a wire mesh, and more particularly a stainless steel wire mesh, is embedded into the enclosure spanning the cavity across the input end of the microphone. In application, the grommet as described is fit over the input end of the microphone.

20 Claims, 3 Drawing Sheets

METHOD OF DETECTING AND DETERRING MICROPHONE SABOTAGE

BACKGROUND OF THE INVENTION

1. Field of Invention

The invention relates to the field of sound microphones, and more specifically to a method and apparatus for detecting and deterring microphone sabotage.

2. Description of Related Art

In the field of apparatus for securing a premises, one measure of security is to provide a microphone for so-called "glassbreak" protection. It is known in the art, by both protectors and intruders, to monitor the frames of access portals, e.g., doors or windows, against motion that may indicate an intrusion. Therefore, an intruder might attempt to enter secured premises by breaking the glass of a window, rather than opening it. Such attempts to intrude the premises, by breaking a window, door, or other violent breach, are typically noisy events. Therefore, it is known to provide a microphone or other sound detection for glassbreak monitoring.

However, it would further be advantageous to be able to secure the glassbreak microphone against sabotage attempts, and/or to give a visual indication that an attempt to sabotage the microphone has taken place. Certain national and industrial standards in the field require at least such sabotage detection means.

BRIEF SUMMARY OF THE INVENTION

Therefore, in order to achieve this and other objectives, provided by the present invention is a method and apparatus for securing a microphone against damage, and for indicating that at least an attempt to damage or sabotage the microphone has occurred.

Provided by the present invention is a protective grommet for a microphone, the grommet having an enclosure with an internal cavity. The internal cavity is dimensioned to receive an input end of the microphone therein. A membrane, particularly a mesh, and more particularly a wire mesh, and more particularly a stainless steel wire mesh, is embedded into the enclosure spanning the cavity across the input end of the microphone. The stainless steel wire mesh may have an epoxy or other coating.

According to a method of the present invention, a grommet as described is fit over the input end of the microphone.

BRIEF DESCRIPTION OF THE DRAWINGS

These and other features, advantages and benefits will be made apparent through the following descriptions and accompanying figures, where like reference numerals refer to the same features across the various drawings.

DETAILED DESCRIPTION OF THE INVENTION

Figure 1:
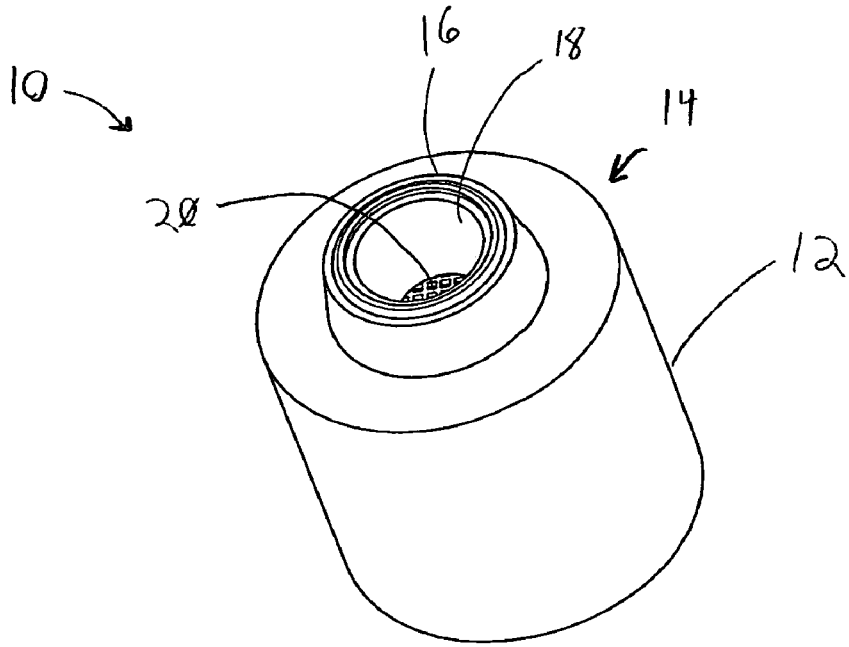
FIG. 1 illustrates in perspective view a protective microphone grommet according to an exemplary embodiment of the present invention.
Figure 2:
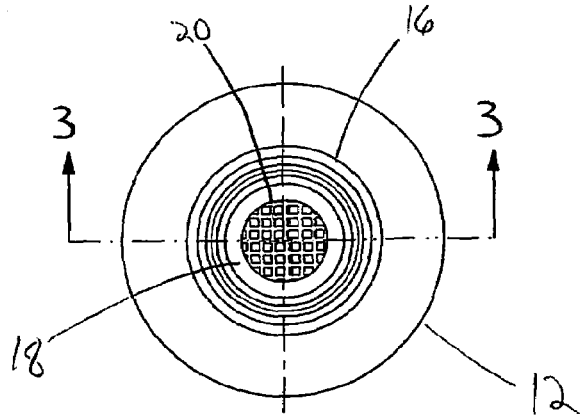
FIG. 2 illustrates a plan view of the protective microphone grommet according to an exemplary embodiment of the present invention.

Referring now to FIG. 1, shown is a protective microphone grommet, generally 10, according to an exemplary embodiment of the present invention. The grommet 10 has an enclosure 12 that is generally circular right cylindrical in shape, though other enclosure shapes are acceptable. At a first end 14 of the grommet 10, a projection 16 forms in its interior at least part of an acoustic cavity 18 to aid the performance of the microphone. A mesh material 20 can be seen at the bottom of the acoustic cavity 18. These features can be seen also in the plan view of FIG. 2.

Figure 3:
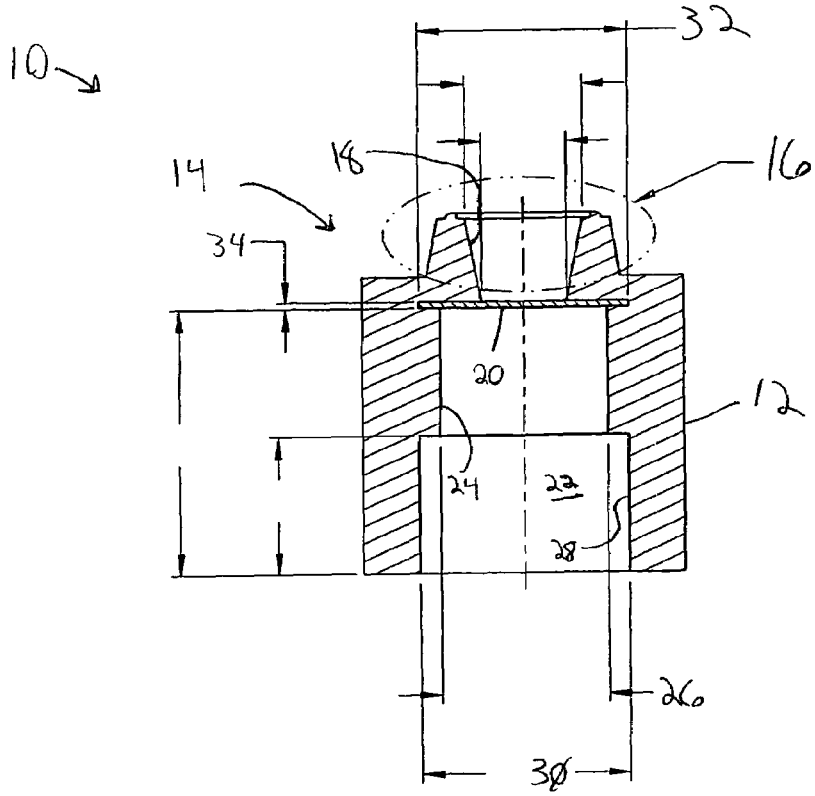
FIG. 3 illustrates a longitudinal cross-sectional view of the protective microphone grommet according to an exemplary embodiment of the present invention, taken along section line 3-3 of FIG. 2.

Referring now to FIG. 3, a longitudinal cross-section is shown. The grommet 10 has an internal cavity 22. A first internal cavity wall 24 has a diameter 26. First internal cavity wall 24 is dimensioned to receive an input end of a microphone. Those skilled in the art will appreciate that various shapes and sizes are equally applicable, and are determined according to the shape of the microphone to be protected. In the exemplary embodiment only, the shape of the microphone to be protected, and particularly the input end thereof, is generally that of a right circular cylinder. The internal cavity 22 of the exemplary grommet 10 is therefore similarly shaped. The internal cavity 22 may have a second internal cavity wall 28 having a diameter 30. Diameter 30 is greater than diameter 26 and may provide additional relief from the surface of the microphone.

A membrane, for example a mesh 20, has a diameter 32, and a thickness 34. Diameter 32 is larger than the diameter 26 of the first internal cavity wall 24. Mesh 20 is embedded into the enclosure 12, particularly in an internal wall, for example first internal cavity wall 24. The mesh 20 spans the internal cavity 22 adjacent the first end 14 of the grommet 10, and closes off the internal cavity 22 across the input end of the microphone. The mesh 20 may be formed of a variety of materials, including, but not limited to, a gauze mesh and a stainless steel wire mesh. In the exemplary embodiment, the mesh 20 is a stainless steel wire mesh. More particularly, the stainless steel mesh is formed of type 304 stainless steel wire, having a wire diameter of about 0.009"; a mesh opening of about 0.011", a wire mesh density of about 50 per inch; a PSW-type weave, with a mesh open area of approximately 30%.

Two considerations are primarily contemplated when choosing a material for the membrane. First is the minimization of any effects on the acoustic response of the microphone. The membrane should be, as near as practicable, acoustically transparent. An additional consideration in selecting the material for the membrane is its visual contrast with the input end of the microphone. Visual contrast may include differences in color, texture, reflectivity, or other characteristic detectable by sight. The input end of a microphone is generally covered with a black felt or similar dark material. It is desirable that the membrane has a contrasting color with that of the input end of the microphone. For example, a gauze mesh having a generally white color is acceptable. Similarly, a stainless steel mesh, left unfinished, will also present a light and contrasting color as compared with the input end of the microphone. Particularly with the stainless steel mesh, a coating, including but not limited to an epoxy or anodizing, having a white, light, or other contrasting color, may be applied to enhance the color contrast with the input end of the microphone.

The enclosure 12 may be formed of a plastic material, more particularly, a neoprene, including but not limited to Royalene 521. It additionally preferred that the material is non-conductive. One method of manufacture contemplated is a molding process, whereby the mesh 20 is held at the parting line of a two-piece mold. The mold cavity would define the features of the enclosure 12. In this way, the mesh 20 would be located and embedded into the enclosure 12 during the molding process.

Figure 4:
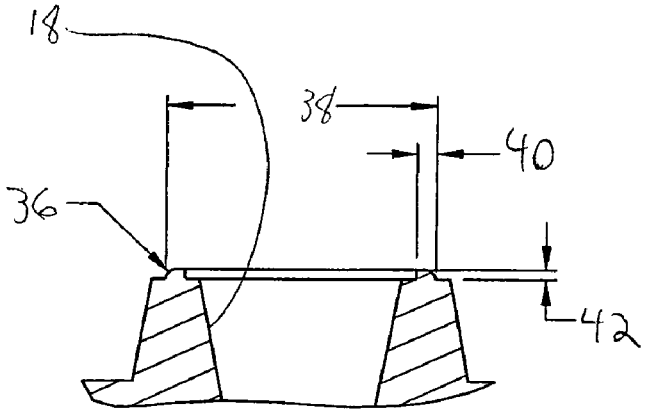
FIG. 4 illustrates an interface ridge formed at the first end of the microphone grommet according to an exemplary embodiment of the present invention, which area is circled in a phantom line ellipse in FIG. 3.

Referring now to FIG. 4, shown is the first end of the grommet 10 is greater detail. Particularly, a ridge 36 is formed which encircles the acoustic cavity 18. Ridge 36 has a diameter 38, a width 40, and a height 42. An outer perimeter of the ridge 36 may be radiused, as shown. Particularly, this ridge 36 is formed to facilitate an interface between the grommet 10 and the outer enclosure of a glassbreak detector, and more particularly with a acoustic cavity of the outer enclosure.

Figure 5:
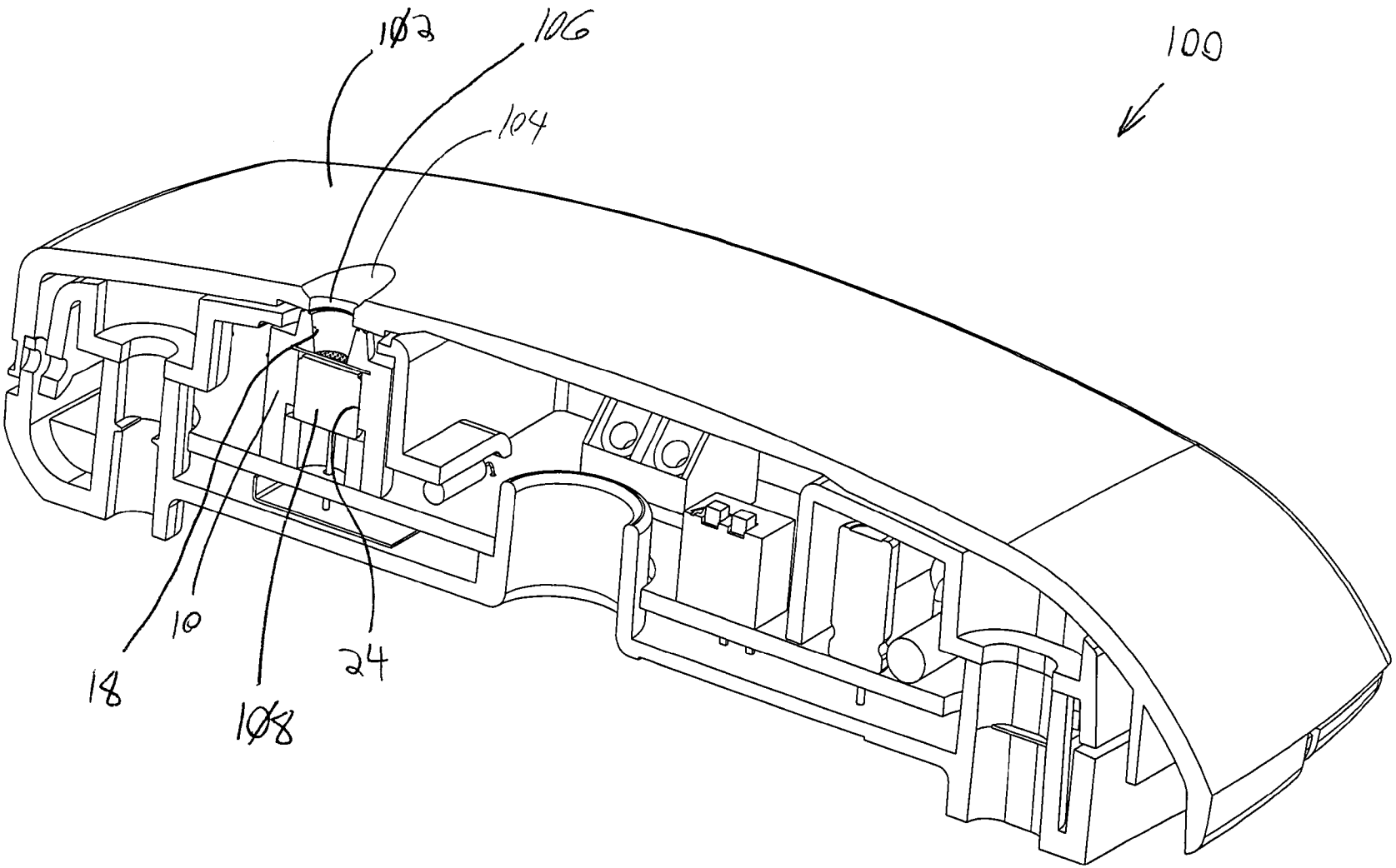
FIG. 5 illustrates a glassbreak detector according to another aspect of the present invention in cross-sectional view.

Referring now to FIG. 5, according to another aspect of the present invention shown in cross-section is a glassbreak detector, generally 100, including a microphone protective grommet 10. Glassbreak detector 100 includes an outer enclosure outer 102. An enclosure acoustic cavity 104 leads to an opening 106, though which sound passes into acoustic cavity 18 of the grommet 10. A microphone 108 is positioned within the internal cavity 22. The outer acoustic cavity 104 and the acoustic cavity 18 of the grommet 10 cooperate to enhance the function of the microphone 108.

As arranged, any attempts to physically sabotage the microphone at its input end via the acoustic cavity 18 would necessarily break the membrane. Therefore, the sabotage attempt would be detectable by visual examination of the assembled microphone and grommet 10. Moreover, any sabotage attempt would have to overcome the material properties of the membrane. A resilient membrane material, on the order of a wire mesh 20 or greater, would provide some measure of protection against the sabotage attempt. Moreover, the visible presence of the membrane may act as a deterrent to a knowledgeable saboteur, who would recognize that there would be evidence of the attempt, and the attempt would not go undetectable.

The present invention has been described herein with reference to certain exemplary and/or preferred embodiments. Certain modifications will be apparent to those skilled in the art, without departing from the scope of the invention. The embodiments described are offered merely as illustrative, and not limiting, on the scope of the present invention, which is defined with reference to the appended claims.

The invention claimed is:

1. A microphone grommet comprising:

an enclosure having an internal cavity, the internal cavity dimensioned to receive an input end of the microphone therein; and a membrane integral with the enclosure spanning the internal cavity across the input end of the microphone having a visual contrast with the input end of the microphone for indicating tampering.

2. The microphone grommet according to claim 1, wherein the enclosure comprises a plastic material.

3. The microphone grommet according to claim 2, wherein the plastic material comprises neoprene.

4. The microphone grommet according to claim 1, wherein the membrane comprises a mesh material.

5. The microphone grommet according to claim 4, wherein the mesh material comprises one or more of a gauze mesh and a stainless steel mesh.

6. The microphone grommet according to claim 5, wherein the mesh material comprises a stainless steel mesh, the stainless steel mesh comprising a coating on at least a portion thereof.

7. The microphone grommet according to claim 6, wherein the coating comprises a color which contrasts with that of the input end of the microphone.

8. The microphone grommet according to claim 6, wherein the coating comprises one or more of an epoxy coating and an anodized coating.

9. The microphone grommet according to claim 1, wherein the membrane comprises a color which contrasts with that of the input end of the microphone.

10. The microphone grommet according to claim 1, wherein the enclosure further comprises an acoustic cavity.

11. The microphone grommet according to claim 10, wherein the acoustic cavity extends from a first end of the enclosure to the membrane.

12. A method of detecting damage to a microphone, the method comprising:

(a) providing an enclosure having an internal cavity, the internal cavity dimensioned to receive an input end of the microphone therein, and a mesh material integral with the enclosure spanning the cavity across the input end of the microphone for indicating tampering and having a visual contrast with the input end of the microphone; and (b) fitting the enclosure over the input end of the microphone.

13. The method according to claim 12, further comprising securing the enclosure and microphone in an outer enclosure.

14. The method according to claim 13, wherein the outer enclosure is a glassbreak detector.

15. The method according to claim 13, wherein the outer enclosure has an opening to admit sound to the microphone.

16. A glassbreak detector comprising:

a microphone;

a protective grommet fit over the input end of the microphone, the protective grommet comprising:

a grommet enclosure having an internal cavity, the internal cavity dimensioned to receive an input end of the microphone therein; and a membrane integral with the enclosure spanning the internal cavity across the input end of the microphone having a visual contrast with the input end of the microphone for indicating tampering; and an outer enclosure surrounding the microphone and microphone grommet.

17. The glassbreak detector according to claim 16, wherein the outer enclosure has an opening to admit sound to the microphone.

18. The glassbreak detector according to claim 16, wherein the grommet enclosure further comprises a first acoustic cavity extending from a first end of the grommet enclosure to the membrane.

19. The glassbreak detector according to claim 18, wherein the outer enclosure further comprises a second acoustic cavity contiguous with the first acoustic cavity of the grommet enclosure.

20. The grommet of claim 1, wherein the membrane is substantially transparent acoustically.

* * * * *